US005804955A

United States Patent [19]

Tuozzolo et al.

[11] Patent Number: 5,804,955

[45] Date of Patent: Sep. 8, 1998

[54] LOW VOLTAGE CURRENT LIMIT CIRCUIT WITH TEMPERATURE INSENSITIVE FOLDBACK NETWORK

[75] Inventors: Claudio Tuozzolo, Cranston; George E. Schuellein, Narragansett, both of R.I.

[73] Assignee: Cherry SemiConductor Corporation, East Greenwich, R.I.

[21] Appl. No.: 741,625

[22] Filed: Oct. 30, 1996

[51] Int. Cl.[6] ..... G05F 1/56

[52] U.S. Cl. ..... 323/277; 323/274

[58] Field of Search ..... 323/268, 270, 323/271, 273, 274–277, 282, 284, 312, 313, 908; 361/18

[56] References Cited

U.S. PATENT DOCUMENTS

| | | | |
|---|---|---|---|
| 3,796,943 | 3/1974 | Nelson et al. | 323/9 |
| 4,326,245 | 4/1982 | Salen | 363/79 |
| 4,338,646 | 7/1982 | Davis et al. | 361/18 |
| 4,704,572 | 11/1987 | Melbert | 323/275 |
| 4,823,070 | 4/1989 | Nelson | 323/285 |
| 4,851,953 | 7/1989 | O'Neill | 361/101 |
| 4,926,109 | 5/1990 | Koterasawa | 323/274 |
| 5,570,060 | 10/1996 | Edwards | 327/541 |
| 5,578,916 | 11/1996 | Muterspaugh | 323/267 |

OTHER PUBLICATIONS

1978 "Power Integrated Circuits: Problems, Tradeoffs, and Solutions," *IEEE Journal of Solid–State Circuits* 13:307–318.

*Primary Examiner*—Matthew V. Nguyen
*Attorney, Agent, or Firm*—Bromberg & Sunstein LLP

[57] ABSTRACT

A voltage regulator with a current limit circuit for limiting pass current in a pass transistor below a current limit threshold and a foldback circuit for lowering the current limit threshold when the voltage differential between the input and output terminals of the voltage regulator exceeds a foldback threshold, where the current limit threshold has a negative temperature coefficient, the current limit circuit comprising two transistors coupled to a sense resistor such that the difference in emitter-to-base voltages of the transistors is equal to the voltage drop of the sense resistor, where the collectors of the two transistors provides first and second currents to first and second resistors, respectively, where the first current is responsive to a pass current flowing through the sense resistor and decreases when the pass current increases, where the second current is independent of the pass current, and the foldback circuit provides a third current to the second resistor when the voltage differential between the input and output terminals of the voltage regulator exceeds the foldback threshold. A comparator circuit compares a first voltage drop developed across the first resistor with a second voltage drop developed across the second resistor, and limits base current to the pass transistor based upon the ratio of first and second voltage drops to thereby prevent the pass current from exceeding the current limit threshold.

17 Claims, 2 Drawing Sheets

LOW VOLTAGE CURRENT LIMIT CIRCUIT WITH TEMPERATURE INSENSITIVE FOLDBACK NETWORK

FIELD OF THE INVENTION

The present invention relates to a current limit circuit and a foldback circuit used in linear voltage regulators. More particularly, the invention relates to a current-limit circuit and a foldback circuit with temperature compensated overload protection, operating solely off the input-output voltage differential of the voltage regulator without increasing its dropout voltage.

BACKGROUND OF THE INVENTION

Internal protection circuits are provided in voltage regulators to prevent permanent damage that could occur under accidental overloads. Typically, protection against short-circuits is provided by a current limit circuit, whereby the pass current flowing through a pass transistor is kept below a current limit threshold. For three-terminal voltage regulators, it is desirable for a current limit circuit to operate from the input-output voltage differential of the voltage regulator because the output terminal of the voltage regulator is used as a common reference. It is also desirable for a voltage regulator with a current limit circuit to have a low dropout voltage, typically in the neighborhood of 1 volt. Furthermore, it is desirable for the current limit threshold to have a negative temperature coefficient, so that the current limit threshold decreases as the temperature of the regulator increases.

Foldback circuits are also provided in voltage regulators to protect the pass transistor from second breakdown caused by thermal instabilities during high power operation. High power operation can result in the formation of hot spots within localized areas of the pass transistor, causing current conduction in the transistor to be non-uniform and concentrated at these hot spots, eventually leading to device burnout. In order to avoid second breakdown, the device needs to be operated within its safe operating area under all operating conditions. A foldback circuit decreases the current limit threshold when the input-output voltage differential exceeds a given foldback threshold, thereby protecting the pass transistor from thermal runaway failure. As for the current limit circuit, it is desirable that a voltage regulator with a foldback circuit have a low dropout voltage, and that the foldback circuit operates from the voltage differential and has a foldback threshold with a negative temperature coefficient.

SUMMARY OF THE INVENTION

It is an aspect of the present invention to provide a current limit circuit for current limit protection and a foldback circuit for safe operating area protection of a voltage regulator, where the current limit and foldback circuits operate directly from the input-output voltage differential without increasing the dropout voltage of the regulator circuit.

It is also an aspect of the present invention to provide current limit and foldback circuits with a controlled negative temperature coefficient for the current limit threshold and foldback threshold, respectively, to ensure that the output pass transistor of the voltage regulator always operates in its safe operating area.

A preferred embodiment of the present invention comprises a current limit circuit utilizing a pair of transistors coupled to a metal sense resistor, where the metal sense resistor is connected to the collector of the pass transistor. The difference in base-to-emitter voltages for the pair of transistors is equal to the voltage drop developed across the sense resistor. This pair of transistors provides two currents to two resistors, where one current is responsive to the pass current flowing in the sense resistor and the other current is substantially independent of the pass current. A comparator circuit is coupled to the two resistors and is responsive to the two voltage drops developed across the two resistors. The comparator circuit ultimately limits base current to the base of the pass transistor when the pass current in the sense resistor exceeds a current limit threshold. Because of the way in which the pair of transistors is coupled to the sense resistor, the temperature coefficient of the current limit threshold can be made negative provided the temperature coefficient of the sense resistor is chosen larger than the temperature coefficient of the thermal voltage $V_T$=kq/T. A preferred embodiment of the present invention also includes a temperature compensated foldback network which reduces the current limit threshold when the input-output voltage differential exceeds a foldback threshold, without significantly adding to the complexity of the circuit.

DETAILED DESCRIPTION OF THE INVENTION

Figure 1:
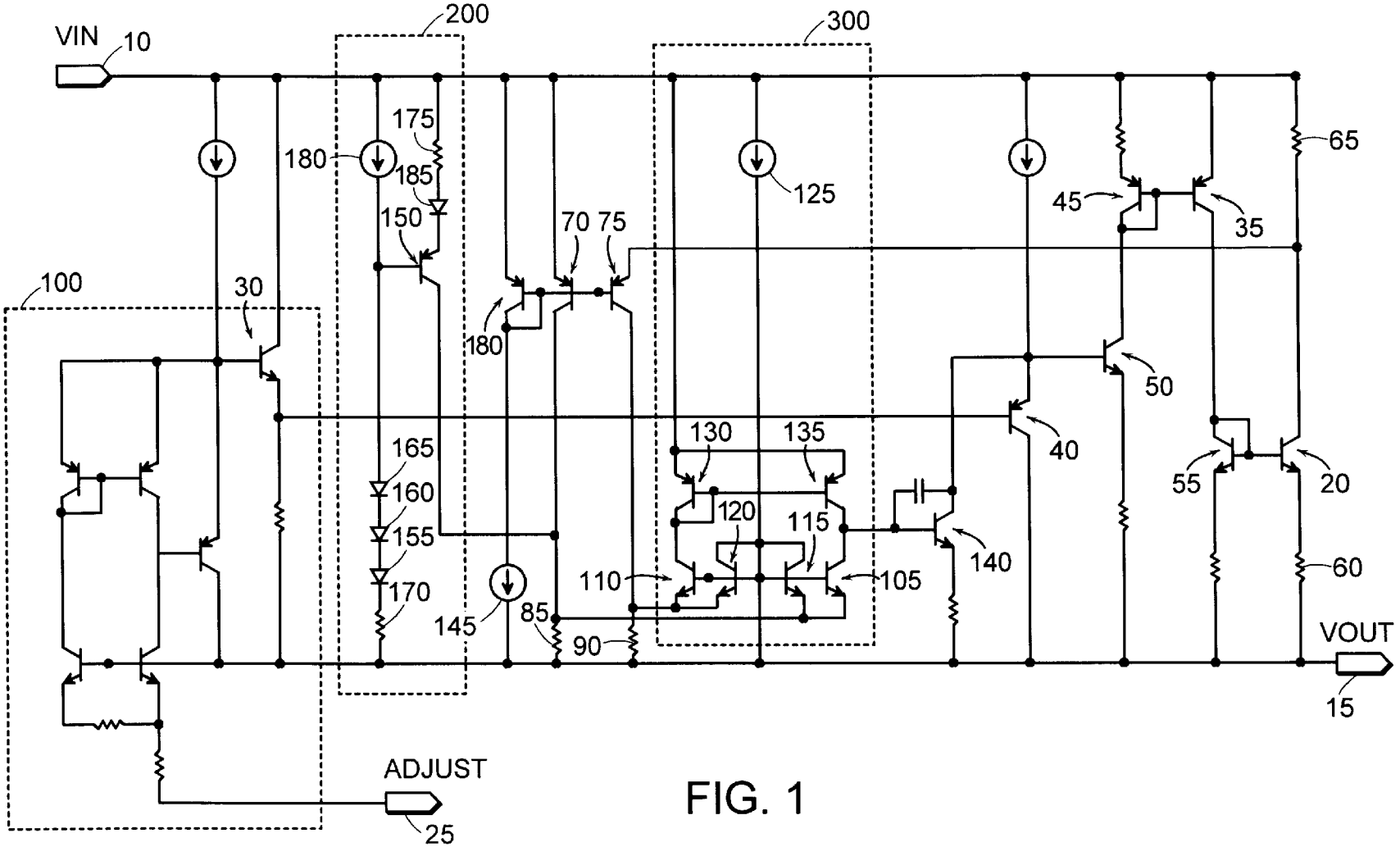
FIG. 1 is a circuit schematic of an embodiment of the invention.

A schematic of an embodiment of the present invention is shown in FIG. 1. When an input voltage is applied to input voltage terminal 10, load current $I_0$ is conducted between input voltage terminal 10 and output voltage terminal 15 by power pass transistor 20 in response to a control signal generated by control circuit 100. The control circuit maintains a reference voltage of approximately 1.2 V (the so-called bandgap reference) between output voltage terminal 15 and control or adjustment terminal 25 by generating a corrective error signal at the emitter of transistor 30 to regulate the voltage drop across power transistor 20 such that the condition Vout−Vadj=1.2 V is fulfilled, where Vout and Vadj are the respective voltages of the output voltage and adjustment terminals.

Transistors 35, 40, 45, 50, 55 and 20 form the output stage of the regulator. Control circuit 100 drives the emitter of transistor 30 in such a manner that when the output voltage Vout rises above the desired regulated value, the voltage at the emitter of transistor 30 decreases, in turn causing a decrease in the current conducted by transistors 50, 45, 35, 55 and 20 of the output stage.

Power transistor 20 is conventionally structured comprising individual base regions with a number of individually ballasted emitter stripes. Resistor 60 represents the ballast resistors for the individual emitter stripes of transistor 20. Diode-connected transistor 55 forms a controlled-gain section where the effective current gain is equal to the emitter area ratio of transistor 20 to that of transistor 55.

The output current $I_0$ conducted by the voltage regulator of FIG. 1 is sensed by sense resistor 65 which is in series with the collector of power transistor 20. Actually, the output current of the voltage regulator is equal to the current in the sense resistor minus the emitter current of transistor 75.

However, this emitter current is relatively insignificant, and therefore we treat the output current as equal to the current in the sense resistor.

Resistor 65 must have a low resistance value to avoid reduction in dropout voltage and an increase in power dissipation. For these reasons, resistor 65 is realized by utilizing a portion of the metal which connects the collector of power transistor 20 to voltage terminal 10. In the preferred embodiment, the metal forming the sense resistor is aluminum. The resistance of resistor 65 cannot be too low for reasons of precision and in the present embodiment it is approximately equal to 0.05 Ohms.

The voltage developed across resistor 65 is related to the output current of the regulator and is sensed by transistors 70 and 75. As seen in FIG. 1, the bases of transistors 70 and 75 are at the same potential, and the difference in base-to-emitter voltages of these transistors is equal to the voltage drop developed across resistor 65. Diode-connected transistor 80 provides a reference biasing voltage for transistor 70 such that transistors 70 and 80 form a current mirror programmed by current sink 145. Consequently, the output current of transistor 70 is independent of the output current $I_0$.

The collector of transistor 70 is coupled through resistor 85 to output voltage terminal 15 and is also connected to foldback circuit 200. Because the current conducted by transistor 70 is substantially independent of the output current $I_0$, the voltage drop across resistor 85 will be constant as long as the input to output voltage differential is lower than the foldback threshold (to be discussed later), i.e., transistor 150 is nonconducting. The collector of transistor 75 is coupled to output voltage terminal 15 through resistor 90. Transistors 70 and 75 have different emitter areas, with transistor 75 having an emitter area n times that of transistor 70. A typical value of n is 5, although other values may be used. As a result, transistor 75 conducts five times as much current as that of transistor 70 when the output current $I_0$ is equal to 0.

As the voltage across sense resistor 65 increases, due to an increase in output current $I_0$, the current conducted by transistor 75 decreases, generating a voltage drop across resistor 90 which varies as a function of the magnitude of the sensed current $I_0$.

The voltages at resistors 85 and 90 are provided to comparator circuit 300. Comparator circuit 300 includes a pair of NPN transistors, 105 and 110, connected in a common base configuration and biased by diode-connected transistors 115 and 120, and current source 125. The bias current of these transistors is approximately set to one order of magnitude smaller than the current conducted by transistor 70 so as to not appreciably contribute to the voltage drops across resistors 85 and 90.

The current conducted by transistor 110 is mirrored by the current mirror comprising transistors 130 and 135. Transistor 135 has twice the emitter area of transistor 130 so that the current conducted by transistor 135 is close to twice that of transistor 130. More precisely, taking into account the modulation of base width due to the Early effect, the current ratio $I_{135}/I_{130}$, where $I_{135}$ and $I_{130}$ are the collector currents of transistors 135 and 130, respectively, is given by the relation $$\frac{I_{135}}{I_{130}} = \left[\frac{1+\frac{V_{CE135}}{V_A}}{1+\frac{V_{CE130}}{V_A}}\right]\left[\frac{A_{135}}{A_{130}}\right] \tag{1}$$

where $V_A$ is the Early voltage, $A_{135}/A_{130}$ is the emitter area ratio of transistor 135 to transistor 130, and $V_{CE135}$ and $V_{CE130}$ are the collector-emitter voltages of transistors 135 and 130, respectively.

Under normal operating conditions, the voltage drop across resistor 90 is higher than the voltage drop across resistor 85. The voltage drop across resistor 90 is typically 200 mV when the regulator output current is zero, and is a decreasing function in the magnitude of the output current $I_0$ due to the increasing voltage across sense resistor 65. The voltage drop across resistor 85 stays approximately constant, provided foldback circuit 200 is OFF, and is typically 10 mV. Thus, as long as the regulator output current is lower than the current limit threshold and foldback circuit 200 is OFF, transistor 105 tends to conduct more than transistor 110, and in fact, transistor 105 saturates and holds current-limiting transistor 140 OFF. When the voltage drop across resistor 90 drops low enough relative to the voltage drop across resistor 85, transistor 105 begins to come out of saturation. As transistor 105 is brought out of saturation, the voltage at the base of transistor 140 starts to rise until it is high enough to forward bias the base-emitter junction of transistor 140, thereby turning it ON and causing the base current to pass transistor 20 to be reduced. Ignoring for the moment the Early effect, because of the emitter ratio between transistors 135 and 130 being equal to 2, the current limit threshold is reached when the difference in voltage drops across resistors 90 and 85, denoted by Δ, drops down to approximately 18 mV as predicted by the Ebers-Moll relation given below when $I_{105}=2\ I_{110}$, where $I_{105}$ and $I_{110}$ are the collector currents of transistors 105 and 110, respectively, and $V_T=kT/q$ is the thermal voltage which is approximately equal to 26 mV at 300 degrees Kelvin.

$$\frac{I_{105}}{I_{110}} = \exp\left(\frac{\Delta}{V_T}\right) \tag{2}$$

In the above expression, the base currents of transistors 105 and 110 have been neglected.

Because of the Early effect, an increase in the input-output voltage differential of the voltage regulator will cause a lowering of the current threshold limit independently of the effect of the foldback circuit upon lowering the current threshold limit. To see this, note that the collector-emitter voltage of transistor 130 is equal to its base-to-emitter voltage, as it is connected as a diode. The collector-to-emitter voltage of transistor 135, on the other hand, is approximately equal to the input-output voltage differential minus the base-emitter voltage of transistor 140. Therefore, an increase in the input-output voltage differential will cause an increase in $V_{CE135}$, which causes an increase in the current ratio due to the Early effect, see eq. (1). With an increase in the current ratio $I_{135}/I_{130}$, the current limit threshold will be reached when eq. (2) is satisfied for $I_{105}>2I_{110}$, which in turn corresponds to a voltage differential $\Delta>18$ mV and a corresponding smaller voltage regulator maximum output current $I_{max}$. This results in a variation in short circuit current, below the foldback threshold, of approximately 0.08 A/V.

The present invention also incorporates a temperature compensation scheme to ensure that variations in the current limit threshold due to temperature are contained within tolerable limits. More specifically, a slight negative temperature coefficient is introduced so that as the junction temperature of pass transistor 20 increases, the current limit threshold decreases. This negative temperature coefficient is achieved by exploiting the temperature dependence of the thermal voltage $V_T$=kT/q and the metal sense resistor 65, as will now be discussed.

The current limit threshold is approached as the voltage differential Δ drops down to approximately 18 mV due to the voltage developed across sense resistor 65 by the regulator output current $I_0$. For example, with a sense resistor 65 of 0.045 Ω, the current limit threshold is reached when the voltage drop across sense resistor 65 is approximately 90 mV, where we have assumed that the input-output voltage differential is less than the foldback threshold. The difference in base-to-emitter voltages of transistors 70 and 75 is equal to the voltage drop across sense resistor 65, $$V_{BE70}-V_{BE75}=R_sI_0,$$

where $R_s$ is the resistance of sense resistor 65, and $V_{BE70}$ and $V_{BE75}$ are the base-to-emitter voltages of transistors 70 and 75, respectively. Using the Ebers-Moll relation with the above equation, we obtain $$V_T \ln\left[\frac{I_{70}A_{75}}{I_{75}A_{70}}\right]=R_sI_0,$$

where $A_{75}/A_{70}$ is the emitter area ratio of transistors 75 and 70 and $I_{70}$ and $I_{75}$ are collector currents of transistors 70 and 75, respectively.

For an emitter area ratio of $A_{75}/A_{70}$=5, we see from the above displayed equation that the maximum output current, $I_{max}$, delivered by the voltage regulator is $$I_{max}=\frac{V_T}{R_s}\ \ln 5\left(\frac{I_{70}}{I_{75}}\right)_0,$$

where $(I_{70}/I_{75})_0$, is the ratio of currents which triggers comparator circuit 300 to bring transistor 105 out of saturation.

From the above equation, we see that the temperature dependence of $I_{max}$ is mainly due to $V_T/R_S$. Therefore, to provide for a current limit threshold with a negative temperature coefficient, the temperature coefficient of $R_s$ should be chosen to be greater than the temperature coefficient of $V_T$, which is approximately 0.33%/°C. In the present embodiment, the variation of metal sense resistor 65 is approximately 0.4%/°C., and therefore $I_{max}$ is a decreasing function of temperature, as can been seen by taking the derivative $I_{max}$ with respective to T, and $I_{max}$ exhibits a temperature variation of approximately −0.07%/°C. Because metal sense resistor 65 is formed from the metal coupled to the collector of transistor 20, its temperature is close to that of the collector junction of transistor 20. Therefore, we see that if the temperature coefficient of metal sense resistor 65 is large enough, the current limit threshold $I_{max}$ will decrease as the junction temperature of pass transistor 20 increases, and therefore the current limit circuit of the present embodiment will have a current limit threshold with a negative temperature coefficient.

The temperature coefficient of the sense resistor is a function of the type of metal used to form the sense resistor. As discussed earlier, in the preferred embodiment the sense resistor is aluminum (which may contain approximately 2% copper). However, other conductive materials may be used.

In addition to the current limit function described above, the embodiment of the present invention includes foldback circuit 200 which further limits the output current of the regulator when the voltage differential between input and the output voltage terminals and 15 increases above a foldback threshold. The foldback network is included to prevent a potentially destructive failure mechanism, known as second breakdown, that may occur in the power transistor 20 due to the formation of so-called hot-spots within localized areas of the transistor. It is therefore necessary to ensure that transistor 20 is operated within its safe operating area (SOA) under all operating conditions.

The foldback circuit 200 comprises transistor 150, diodes 155, 160, 165, and 185, resistors 170 and 175, and current source 180. Let the sum of the forward voltage drops of diodes 155, 160, and 165, and the voltage drop developed across resistor 170 be denoted by $V_{ref}$. Then the voltage at the base of transistor 150 is $V_{OUT}+V_{ref}$. For input-output voltage differentials satisfying the condition $V_{IN}-V_{OUT}<V_{ref}+V_{BE150}+V_{185}$, where $V_{IN}$ is the voltage at input voltage terminal 10, $V_{OUT}$ is the voltage at output voltage terminal 15, $V_{BE150}$ is the base-emitter voltage of transistor 150, and $V_{185}$ is the forward voltage drop of diode 185, transistor 150 is OFF and there is no additional voltage drop being added across resistor 85. As the input-output voltage differential exceeds the foldback threshold value $V_{TH}=V_{ref}+V_{BE150}+V_{185}$, transistor 150 starts to conduct and its collector current starts to flow through resistor 85, thereby raising the voltage drop across it and lowering the current limit threshold.

The foldback threshold $V_{TH}$ can easily be adjusted by properly choosing the number of series connected diodes and the voltage drop across resistor 170 and, depending on the desired foldback threshold, a base-emitter voltage multiplier can be used in place of the series-connected diodes. Other means for providing a voltage drop may be substituted for some or all of the diodes and resistors in foldback circuit 200. For example, Zener diodes may be substituted for some or all of the diodes, or a $V_{BE}$ multiplier circuit may be used in place of some or all of the diodes.

The rate at which the current limit threshold decreases, as the input-output voltage differential increases above $V_{TH}$, is dependent on resistor 175, which sets the current conducted by transistor 150, denoted as $I_{150}$, according to the following relationship:

$$I_{150}=\frac{(V_{IN}-V_{OUT})-V_{TH}}{R_{175}},$$

where $R_{175}$ is the resistance of resistor 175.

The components of the foldback circuit described above may be selected so as to uniquely provide a substantially temperature independent foldback threshold $V_{TH}$. In fact, its temperature variation can be easily adjusted to any level by changing the value of the current sourced by current source 180 and the resistance of resistor 170. Preferably, the foldback threshold is chosen to have a slight negative temperature coefficient so that current limiting occurs at a lower input-output voltage differential as the junction temperatures of the devices making up foldback circuit 200 increase. In the present embodiment, a $V_{TH}$ temperature variation of 0.005%/°C. has been chosen, although other values may be used. Temperature compensation can be achieved by canceling the negative temperature coefficients of the series-connected diodes 155, 160, 165, and 185, and the base-emitter voltage of transistor 150, with a correcting voltage, $V_{PTAT}$, exhibiting a positive temperature coefficient, where $V_{PTAT}$ is proportional to absolute temperature (PTAT) and is the voltage drop developed across resistor 170 by a current provided by a current source, such as source 180.

$V_{PTAT}$ can be easily generated, for a bias current proportional to absolute temperature is generally available in a monolithic integrated circuit. This is the case for current source 180 sourcing a current $I_1$, which is of the form $I_1=(V_T/R)\ln(a)$, where $V_T$ is the thermal voltage, R is a resistance, and a is a temperature-independent constant. Assuming that the forward voltages of diodes 155, 160, 165, and 185 are the same as the base-to-emitter voltage of transistor 150, and by generically denoting each of them as $V_D$, the foldback threshold $V_{TH}$ can be expressed by:

$$V_{TH} = 5V_D + \frac{R_{170}}{R} V_T \ln(a)$$

where $R_{170}$ is the resistance of resistor 170. With proper adjustment of the resistor ratio $R_{170}/R$, or more directly by adjusting the values of $I_1$ and $R_{170}$, the linear temperature dependence of the voltages $5V_D$ is compensated by that of the voltage drop across resistor 170 as can been seen by taking the derivative of $V_{TH}$ with respect to temperature, therefore providing a substantially temperature-independent foldback threshold.

Figure 2:
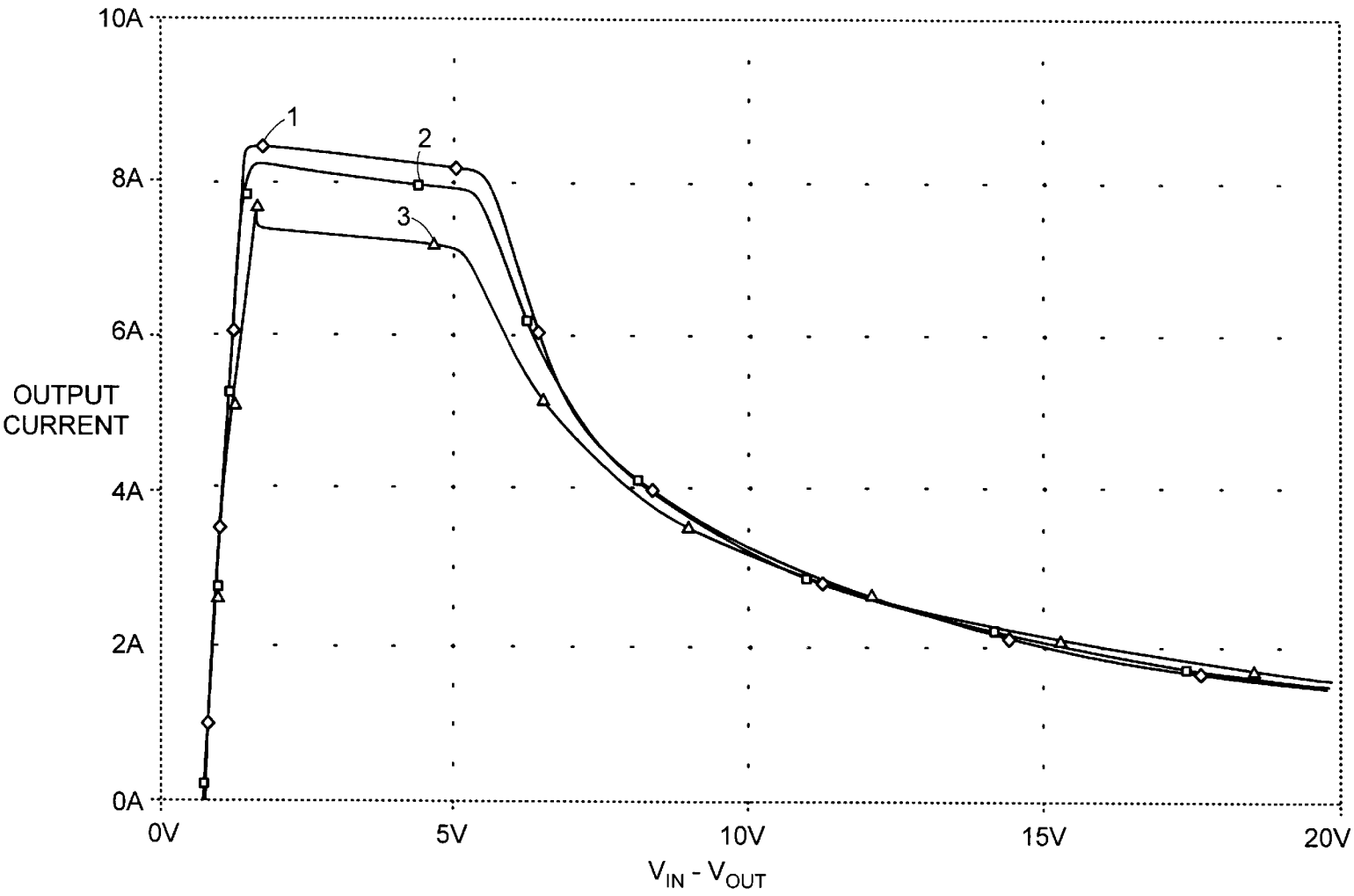
FIG. 2 is a plot of output current vs. $V_{IN}-V_{OUT}$ when $V_{OUT}$ is shorted to ground at temperatures 0° C., 25° C., and 150° C. for an embodiment of the invention.

FIG. 2 shows how the voltage regulator output current is affected by the current limit circuit of the present invention, with curves 1, 2 and 3 respectively representing the output current of the regulator at temperatures of 0° C., 25° C. and 150° C. when the output terminal Vout is shorted to ground.

Foldback circuit 200 is ON, due to transistor 150 being ON, when the input-output differential is approximately 5 volts, and causes current limiting to occur at lower values of short circuit current as the input-output voltage differential increases above 5 volts. As can be seen from FIG. 2, the short circuit current exhibits a slight negative temperature coefficient of approximately −0.07%/°C. when the input-output voltage differential is less than 5 volts, and the foldback threshold is substantially independent from temperature.

FIG. 2 also illustrates a dependence of the short circuit current on input-output voltage differentials even below the foldback threshold. This is due to base-width modulation (Early effect) occurring in transistors 130 and 135 because they are operated at different collector-emitter voltages, as discussed earlier.

A high pass current may introduce voltage drops across wire bonds, as well as the wires themselves. So that these voltage drops do not effect the regulation of voltage by control circuit 100, in a preferred embodiment implemented as an integrated circuit chip, transistor 40, and the emitter resistors of 50, 55, and 20, are connected directly to the output terminal 15 as indicated in FIG. 1, but the rest of the circuit in FIG. 1 which is connected to terminal 15 is instead connected directly to another terminal, which may be denoted as the $V_{OUT_SENSE}$ terminal. Dedicated bond wires connect $V_{OUT}$ with $V_{OUT_SENSE}$, so that the integrated circuit functions as the circuit indicated in FIG. 1.

Numerous modifications may be made to the embodiments described above without departing from the spirit and scope of the invention. For example, any suitable transresistance device may be used in place of resistors 85 and 90. For example, a transresistance amplifier with small input and output impedances and which develops an output voltage proportional to its input current may be substituted for resistor 90 in which one input terminal of the transresistance amplifier is connected to the collector of transistor 75, the other input terminal is connected to $V_{OUT}$ terminal 15, one output terminal is connected to the emitter of transistor 110, and the other output terminal is connected to $V_{OUT}$ terminal 15.

What is claimed is:

1. A current limit circuit, with an output voltage terminal, for limiting a pass current flowing through a sense resistance device coupled to a collector of a pass transistor, the current limit circuit comprising:

a first current means for providing a first current responsive to the pass current when the first current means is coupled to the sense resistance device;

a second current means, coupled to the first current means, for providing a second current;

a first resistor means, having an input coupled to the first current means, for receiving the first current and for generating a first voltage differential responsive to the total current flowing into the input of the first resistor means;

a second resistor means, having an input coupled to the second current means, for receiving the second current and generating a second voltage differential responsive to the total current flowing into the input of the second resistor means; and a comparator circuit with first and second inputs coupled to the first and second resistor means, respectively, and responsive to the first and second voltage differentials, and having an output for preventing the pass current from exceeding a current limit threshold.

2. The current limit circuit as set forth in claim 1, wherein the temperature coefficient of the current limit threshold is negative when the temperature coefficient of the sense resistance device is positive and is larger than the temperature coefficient of a thermal voltage $V_T$, where $V_T=kT/q$, k is Boltzmann's constant, q is the coulomb charge of an electron, and T is absolute temperature.

3. The current limit circuit as set forth in claim 1, wherein the first current means includes a first transistor having an emitter coupled to a first terminal of the sense resistance device, having a collector coupled to the input of the first resistor means to provide the first current, and having a base;

the second current means includes a second transistor having an emitter coupled to a second terminal of the sense resistance device, having a base coupled to the base of the first transistor, and having a collector coupled to the input of the second resistor means, wherein the second transistor's emitter and base are biased such that its collector provides the second current, wherein the second current is substantially independent of the pass current; and the absolute value of the difference in base-to-emitter voltages of the first and second transistors is substantially equal to the absolute value of the voltage drop across the sense resistance device.

4. The current limit circuit as set forth in claim 3, wherein the temperature coefficient of the sense resistance device is not less than the temperature coefficient of a thermal voltage $V_T=kT/q$, where k is Boltzmann's constant, T is absolute temperature, and q is the coulomb charge of an electron.

5. The current limit circuit as set forth in claim 3, wherein the comparator circuit further comprises:

a third transistor having an emitter coupled to the first resistor means and being responsive to the first voltage differential, having a base, and having a collector;

a fourth transistor having an emitter coupled to the second resistor means and being responsive to the first voltage differential, having a base coupled to the base of the third transistor, and having a collector coupled to the output of the comparator circuit; and a current mirror coupled to the collectors of the third and fourth transistors, wherein the fourth transistor is in saturation when the first and second voltage differentials do not satisfy a relationship and is not in saturation when the first and second voltage differentials satisfy the relationship.

6. The current limit circuit as set forth in claim 5, further comprising:

a fifth transistor having a base, having an emitter coupled to the second terminal of the sense resistance device, and having a collector coupled to the input of the second resistor means;

a current source coupled to the base of the fifth transistor;

at least one diode coupled in a circuit path defined by the second terminal of the sense resistance device, the emitter of the fifth transistor, the base of the fifth transistor, and the output voltage terminal;

a resistor coupled between the current source and the output voltage terminal, the resistor being in series with the at least one diode; and wherein when a voltage difference between the second terminal of the sense resistance device and the output voltage terminal exceeds a foldback threshold, the collector of the fifth transistor provides a third current to the input of the second resistor means so that the current flowing into the input of the second resistor means is substantially equal to the sum of the second and third currents.

7. The current limit circuit as set forth in claim 6, wherein:

the current source provides a current substantially proportional to $V_T/R$, where R is a resistance; and the resistance R and the resistance of the resistor are such that the temperature coefficient of the foldback threshold is not greater than zero.

8. The current limit circuit as set forth in claim 3, wherein the second current means further comprises:

a third transistor having an emitter coupled to the emitter of the second transistor, having a base coupled to the base of the second transistor, and having a collector coupled to its base; and a current sink, coupled to the collector of the third transistor, for sinking a third current, wherein the second transistor is biased by the third transistor such that the second current is substantially equal to the third current.

9. The current limit circuit as set forth in claim 1, wherein the comparator circuit further comprises:

a first transistor having an emitter coupled to the first resistor means and being responsive to the first voltage differential, having a base, and having a collector;

a second transistor having an emitter coupled to the second resistor means and being responsive to the second voltage differential, having a base coupled to the base of the first transistor, and having a collector coupled to the output of the comparator circuit; and a current mirror coupled to the collectors of the first and second transistors, wherein the second transistor is in saturation when the first and second voltage differentials do not satisfy a relationship and is not in saturation when the first and second voltage differentials satisfy the relationship.

10. A current limit circuit coupled between an input voltage terminal and an output voltage terminal for limiting a pass current flowing through a sense resistance device coupled between the input voltage terminal and a pass transistor, the current limit circuit comprising:

a first transistor having a base, an emitter coupled to the sense resistance device, and a collector;

a second transistor having a base coupled to the base of the first transistor, an emitter coupled to the input voltage terminal, and a collector;

a first resistor having a first terminal coupled to the collector of the first transistor and a second terminal coupled to the output voltage terminal;

a second resistor having a first terminal coupled to the collector of the second transistor and a second terminal coupled to the output voltage terminal;

a comparator circuit having a first input coupled to the first terminal of the first resistor, a second input coupled to the first terminal of the second resistor, and an output coupled to the pass transistor for preventing the pass current from exceeding a current limit threshold; and a foldback circuit coupled to the input voltage terminal, the output voltage terminal, and the first terminal of the second resistor, wherein the foldback circuit provides a current to the second resistor when the voltage difference between the input and output voltage terminals exceeds a foldback threshold.

11. The current limit circuit as set forth in claim 10, wherein the sense resistance device comprises a portion of a metal coupling the collector of the pass transistor to the input voltage terminal and has a positive temperature coefficient not less than the temperature coefficient of a thermal voltage $V_T$, where $V_T$=kT/q where k is Boltzmann's constant, q is the coulomb charge of an electron, and T is absolute temperature.

12. The current limit circuit as set forth in claim 11, wherein the foldback circuit comprises:

a first current source coupled to the input voltage terminal;

a first means for providing a voltage drop, coupled to the first current source;

a third resistor coupled to the voltage drop means and the output voltage terminal;

a third transistor having an emitter, a base coupled to the first current source, and a collector coupled to the first terminal of the second resistor; and a second means for providing a voltage drop, coupled to the emitter of the third transistor and the input voltage terminal.

13. The current limit circuit as set forth in claim 12, wherein the comparator circuit comprises:

a fourth transistor having a base, a collector, and an emitter coupled to the first terminal of the first resistor;

a fifth transistor having an emitter coupled to the first terminal of the second resistor, a base coupled to the base of the fourth transistor, and a collector coupled to output of the comparator; and a current mirror coupled to the collectors of the fourth and fifth transistors.

14. The current limit circuit as set forth in claim 13, wherein the comparator circuit further comprises:

a second current source coupled to the base of the fourth transistor;

a sixth transistor having a base coupled to the base of the fourth transistor, a collector coupled to its base, and an emitter coupled to the first terminal of the first resistor; and a seventh transistor having a base coupled to the base of the fourth transistor, a collector coupled to its base, and an emitter coupled to the first terminal of the second resistor.

15. A method of limiting current through a pass transistor in a voltage regulator with an input voltage terminal and an output voltage terminal, the method comprising the steps of:

sensing a pass current flowing through a sense resistance device;

sourcing a first current through a first resistor such that the first current decreases when the pass current increases and the first current increases when the pass current decreases;

sourcing a second current through a second resistor such that the second current is substantially independent of the pass current;

sourcing a third current in conjunction with the second current through the second resistor, wherein the third current is substantially zero when the voltage difference between the input and output voltage terminals is below a foldback threshold;

bringing a first transistor into saturation when there is a first relationship between a first voltage drop across the first resistor and a second voltage drop across the second resistor and bringing the first transistor out of saturation when there is a second relationship between the first and second voltage drops; and bringing a current limiting transistor into conduction when the first transistor is out of saturation, wherein the current limiting transistor reduces base current to the pass transistor to limit the pass current when the current limiting transistor is brought into conduction.

16. The method as set for in claim 15, wherein the step of sourcing the third current comprises the step of bringing a second transistor into conduction when the voltage difference between the input and output voltage terminals exceeds the foldback threshold, wherein the collector of the second transistor is coupled to the second resistor.

17. The method as set forth in claim 16, wherein the step of bringing the first transistor out of saturation comprises the step of providing a fourth current to a collector of the first transistor and a fifth current to a collector of a third transistor, wherein the fourth and fifth currents are obtained from a current mirror and are related to each other by a predetermined ratio, wherein the third transistor has an emitter coupled to the first resistor and the first transistor has an emitter coupled to the second resistor.

* * * * *